US006122876A

United States Patent [19]

Bado et al.

[11] Patent Number: 6,122,876

[45] **Date of Patent: *Sep. 26, 2000**

[54] CLADDING BOARD

[75] Inventors: John Bado, Greenfield Park; Joseph Emmanuel Zarb, Fairfield West, both of Australia

[73] Assignee: James Hardie Research Pty. Limited, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/718,450

[22] PCT Filed: Mar. 24, 1995

[86] PCT No.: PCT/AU95/00168

§ 371 Date: Nov. 20, 1996

§ 102(e) Date: Nov. 20, 1996

[87] PCT Pub. No.: WO95/26450

PCT Pub. Date: Oct. 5, 1995

[30] Foreign Application Priority Data

Mar. 29, 1994 [AU] Australia ..... PM 4781

[51] Int. Cl.[7] ..... E04C 2/38; E04D 1/12; E04D 1/34

[52] U.S. Cl. ..... 52/518; 52/536; 52/520; 52/546; 52/552

[58] Field of Search ..... 52/518, 536, 520, 52/542, 547, 521, 551, 523, 538, 546, 550, 552, 553, 471

[56] References Cited

U.S. PATENT DOCUMENTS

| | | | |
|---|---|---|---|
| 369,216 | 8/1887 | Temple | 52/801.11 |
| 1,399,023 | 12/1921 | Murray . | |
| 2,276,170 | 3/1942 | Elmendorf | 52/544 |
| 2,354,639 | 7/1944 | Seymour | 52/543 |
| 2,447,275 | 8/1948 | Price | 52/547 |
| 2,928,143 | 3/1960 | Newton | 52/547 |
| 3,214,876 | 11/1965 | Mattes | 52/520 |
| 3,416,275 | 12/1968 | Van Loghem et al. | 52/471 X |
| 3,754,365 | 8/1973 | Carrick et al. . | |
| 3,818,668 | 6/1974 | Charniga | 52/547 |
| 3,866,378 | 2/1975 | Kessler | 52/519 |
| 3,992,845 | 11/1976 | Grzesiek et al. | 52/547 |
| 4,586,304 | 5/1986 | Flammand | 52/309.8 |
| 4,641,469 | 2/1987 | Wood . | |
| 5,077,952 | 1/1992 | Moure | 52/547 X |
| 5,349,802 | 9/1994 | Kariniemi | 52/543 |
| 5,501,050 | 3/1996 | Ruel | 52/547 X |
| 5,564,245 | 10/1996 | Rademacher | 52/547 X |
| 5,617,690 | 4/1997 | Gibbs | 52/520 X |

FOREIGN PATENT DOCUMENTS

| | | | |
|---|---|---|---|
| 8401582 | 2/1983 | Australia . | |
| 4687889 | 7/1990 | Australia . | |
| 1084230 | 8/1980 | Canada . | |
| 990242 | 9/1951 | France | 52/285.1 |
| 49-46761 | 12/1974 | Japan . | |
| 5-42192 | 10/1993 | Japan . | |
| 210395 | 11/1984 | New Zealand . | |
| 684285 | 8/1994 | Switzerland . | |
| 119182 | 9/1918 | United Kingdom | 52/514 |
| 558584 | 1/1944 | United Kingdom . | |
| 2252987 | 8/1992 | United Kingdom . | |

*Primary Examiner*—Laura A. Callo
*Attorney, Agent, or Firm*—Knobbe, Martens, Olson & Bear, LLP

[57] ABSTRACT

A cladding board (10) for fixing in partial overlapping relationship with a like board (10). The board (10) includes a longitudinally extending first face (11) which, in use, partially overlaps with the opposing face of a like board (10) and a retaining formation (12) in the first face (11) adapted to captively retain an aligning spline (13) having a complementary retaining formation.

14 Claims, 4 Drawing Sheets

CLADDING BOARD

FIELD OF THE INVENTION

The present invention relates to cladding boards and more particularly to cladding boards for fixing in partial overlapping relationship with one another.

BACKGROUND OF THE INVENTION

As well known in the art, buildings exterior walls are clad with boards to provide an exterior surface ready for painting and the like.

The boards are generally fastened to the wall studs that comprise the frame of a building with an even overlap up the wall. The top portion of a lower board is covered by the bottom portion of the next highest board, with all the boards in a parallel configuration. The boards must be as parallel as possible to provide uniform covering of the frame and to maintain a neat appearance.

Generally, fasteners pierce the top portion of the board and the overlapping by the bottom portion of the next highest board provides a neat appearance by concealing the fasteners.

In this method of construction the lower most board is positioned horizontally, usually with the aid of a spirit level or such device, to establish a datum. The other boards are then positioned to overlap one another, at equal intervals up the frame parallel to this datum, until the frame is concealed.

This method of cladding would generally require at least two people to locate the boards in an even spacing parallel to one another. The boards being up to several meters in length are difficult to position, align and hold in position whilst fasteners are attached. This task becomes even more difficult and time consuming if only one person is attaching the boards to the building frame.

In an attempt to overcome these problems some boards are provided with an aligning spline located near the lower edge of, and parallel to, the board's longest side. These aligning splines require only one board (the lower most) to be positioned horizontally. The aligning splines of successive higher boards locate against the top edge of the board below and as such they are held at a uniform spacing and in a parallel relationship. In this situation only one person is required to insert the fastening means as the board rests under its own weight in the correct position.

However, boards of this type have the aligning spline factory installed and the height of the boards in relation to one another is fixed. Positioning boards at different heights, for example when approaching the top of the building frame, becomes very difficult. Also, when forming butt joints, on corners for example, the spline must be cut away to allow room for the joint, before the board can be positioned. A similar problem is encountered when attempting to use joint trimmers between two boards side by side. As the splines are rigidly attached to the boards they are difficult to trim.

Furthermore, the boards cannot be stacked easily due to the spline protruding from the board. Inventory levels are also required to be higher than normal since both splined and conventional boards may be required to be kept in stock.

DISCLOSURE OF THE INVENTION

It is an object of the present invention to overcome or ameliorate at least some of these deficiencies of the prior art.

According to the invention there is provided a cladding board for fixing in partial overlapping relationship with a like board, said board includes: a longitudinally extending first face which, in use, partially overlaps with the opposing face of a like board; and, a retaining formation in and extending logitudinally along, the first face adapted to captively retain an aligning spline having a complementary retaining formation.

Preferably, the cladding board further comprises an aligning spline with a complementary retaining formation. The aligning spline is preferably releasably engageable with said board.

More specifically, the board is desirably constructed from fibre reinforced cement suitable for exterior cladding of building frames.

By way of example, the retaining formation may include two outwardly diverging surfaces extending into the board.

In an embodiment, the retaining formation is in the form of a pair of outwardly diverging recesses, each of the recesses including one of the surfaces therein.

In another embodiment, the aligning spline may take the form of an extrusion with an end profile of a flat rectangular member having a perpendicular extension, the extension and the corresponding end of the rectangle being configured to mate with the recesses in the board.

In another embodiment, the aligning spline may have an end profile of a dovetail configured to mate with a dovetailed recess in the board.

The complementary retaining formation along the length of the spline may be continuous, or alternatively, intermittent.

A preferred embodiment of the invention will now be described, by way of example only, with reference to the accompanying drawings in which:

MODES FOR CARRYING OUT THE INVENTION

Figure 1:
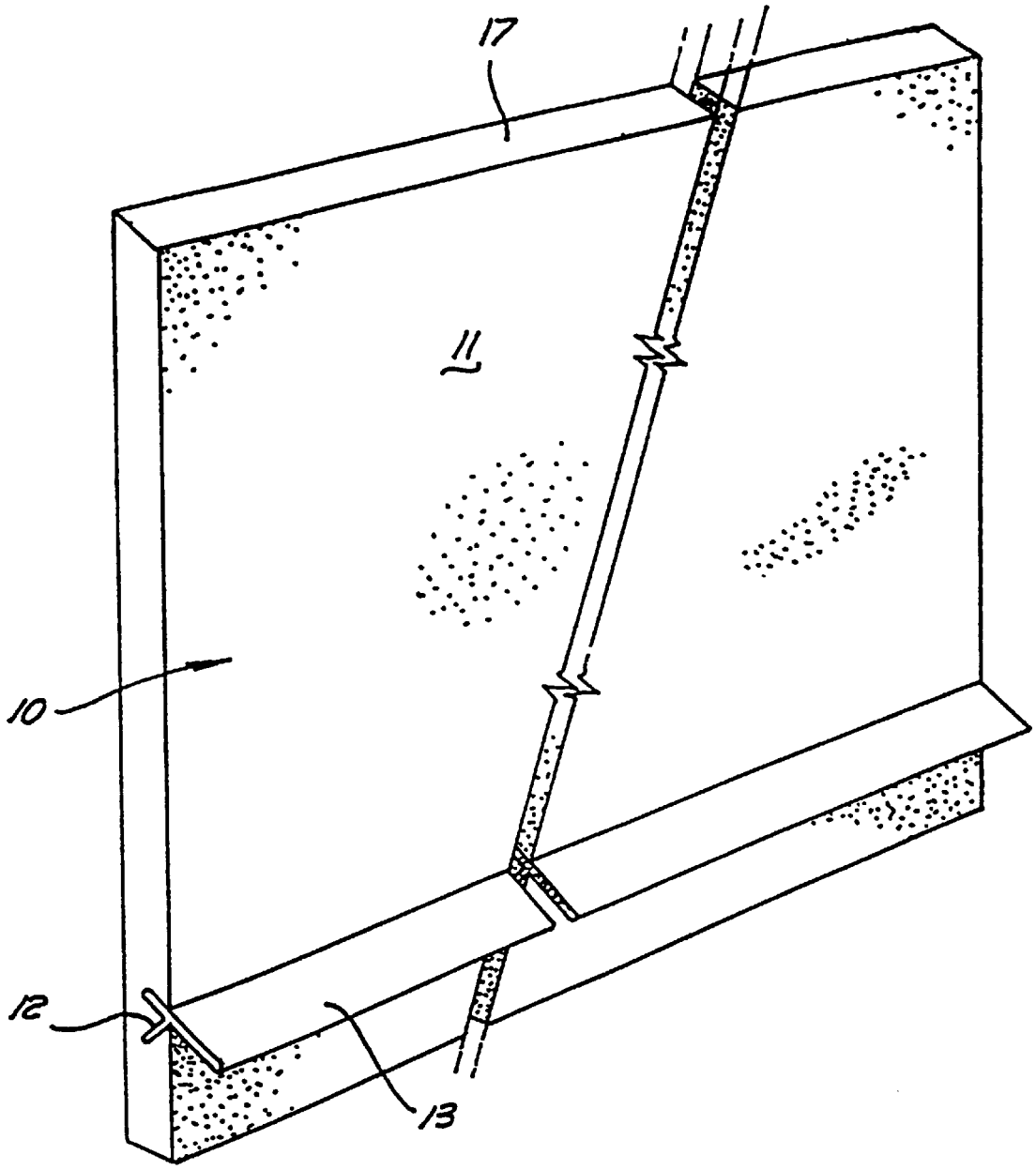
FIG. 1 is a perspective view of an embodiment of a cladding board according to the invention.

Referring to the drawings, a first embodiment of the invention provides a cladding board 10 for fixing in partial overlapping relationship with a like board. The board 10 includes a longitudinally extending first face 11 and a retaining formation 12 adapted to captively retain an aligning spline 13 having a complementary retaining formation.

The board is generally constructed from fibre reinforced cement or other materials suitable for cladding building exteriors.

Retaining formation 12 includes two outwardly diverging surfaces 14*a* and 14*b* extending into the board. The surfaces 14*a*, 14*b* are the outer edge of outwardly diverging recesses 14 formed by two intersecting saw cuts extending into first face 11 at 45° and 135° respectively. The saw cuts in combination form a V-shaped recess having it's apex coincident with the first face 11.

The aligning spline 13 has a retaining formation complementary the retaining formation 12.

To position the aligning spline 13 with board 10, the aligning spline is introduced into the retaining formation 12 by longitudinally sliding the end of aligning spline 13 into the formation 12 as shown in FIG. 1.

Trimming of the aligning spline 13 can be accomplished by sliding a portion, of the aligning spline 13 to be trimmed, out of the board 10 and cutting it with conventional means.

Figure 3:
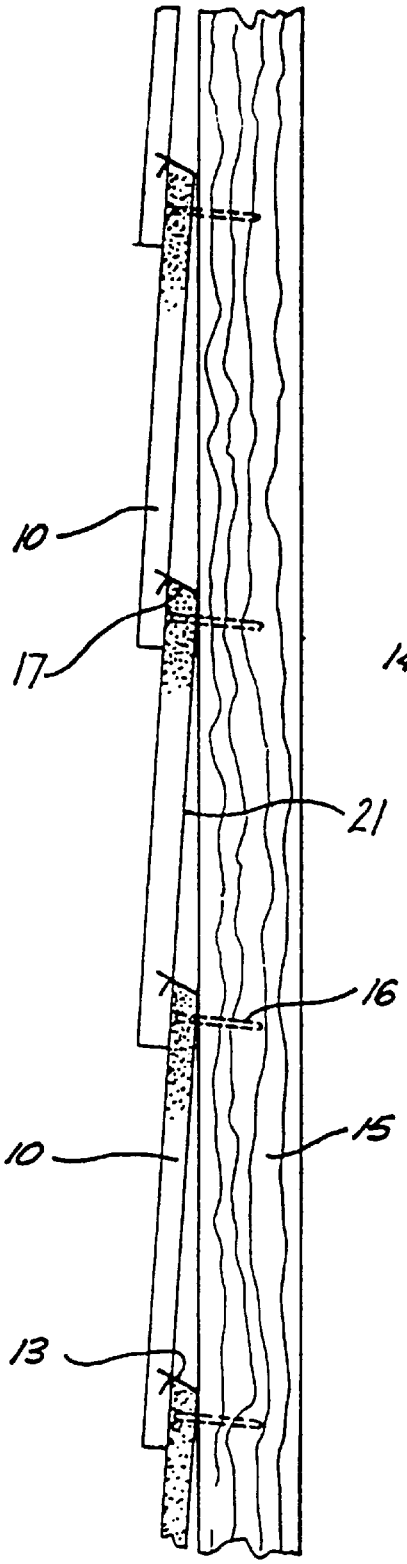
FIG. 3 is an end elevation of several of the boards shown in FIG. 1 attached, in overlapping relationship, to a building frame.
Figure 2:
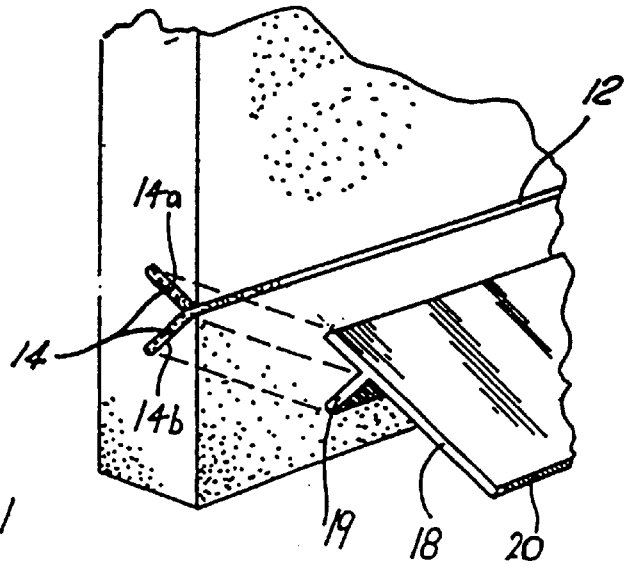
FIG. 2 is an enlarged perspective cutaway view of the cladding board shown in FIG. 1 with the aligning spline removed from the cladding board.
Figure 4:
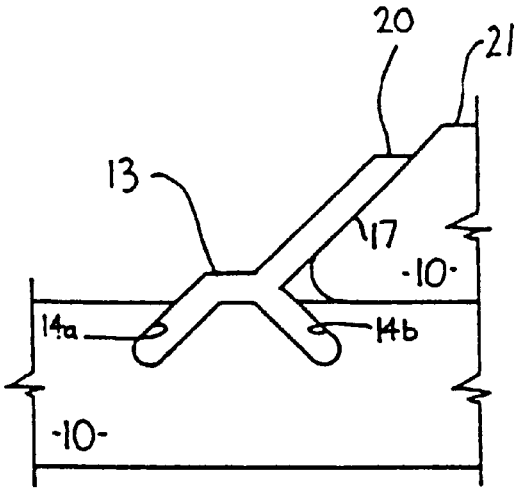
FIG. 4 is a partial end view of a second embodiment of a self aligning board according to the invention shown, in use, abutting an adjacent board.
Figure 7:
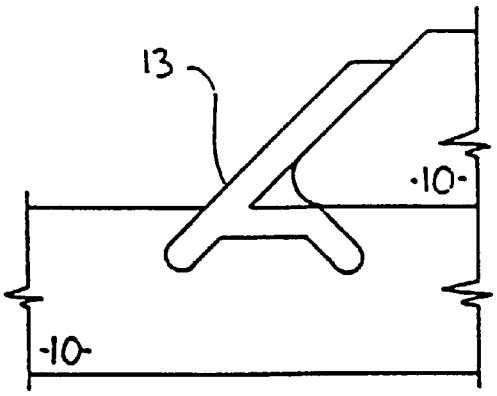
FIG. 7 is a partial end view of a fifth embodiment of a cladding board according to the invention shown, in use, overlapping an adjacent board.
Figure 5:
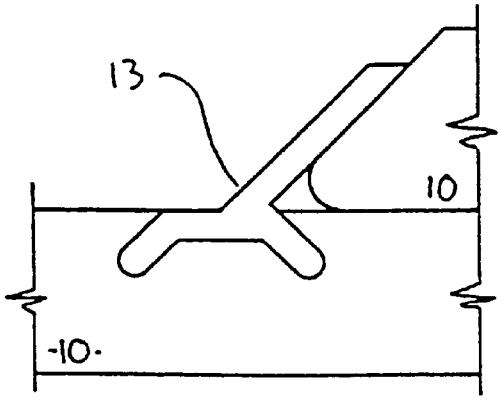
FIG. 5 is a partial end view of a third embodiment of a cladding board according to the invention shown, in use, overlapping an adjacent board.
Figure 8:
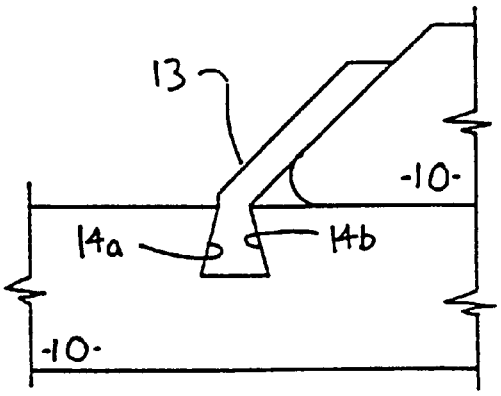
FIG. 8 is a partial end view of a sixth embodiment of a cladding board according to the invention shown, in use, overlapping an adjacent board.
Figure 6:
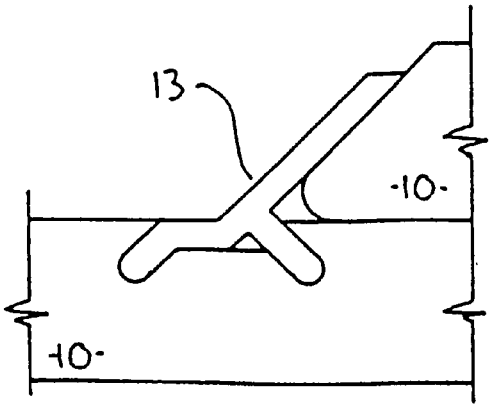
FIG. 6 is a partial end view of a fourth embodiment of a cladding board according to the invention shown, in use, overlapping an adjacent board.
Figure 9:
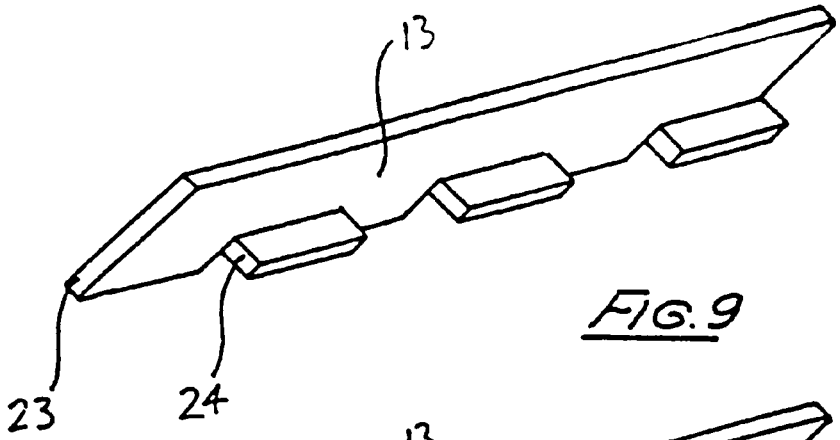
FIG. 9 is an embodiment of an aligning spline for use with the first embodiment of the cladding board according to the invention.
Figure 10:
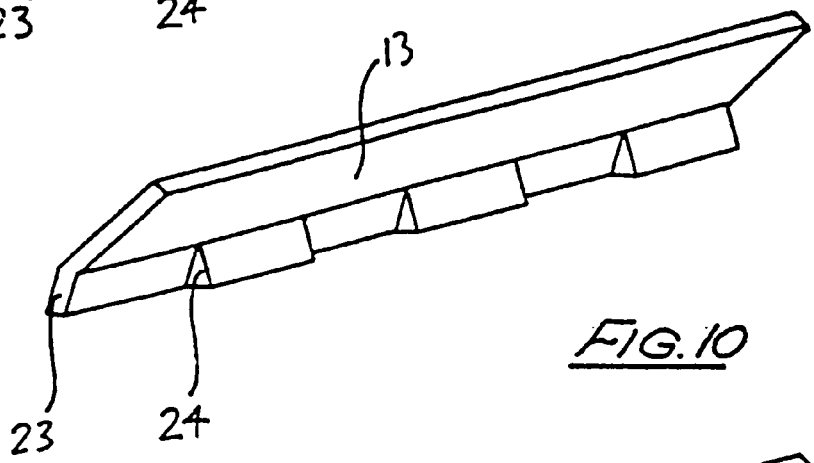
FIG. 10 is an embodiment of an aligning spline for use with the sixth embodiment of the cladding board according to the invention.
Figure 11:
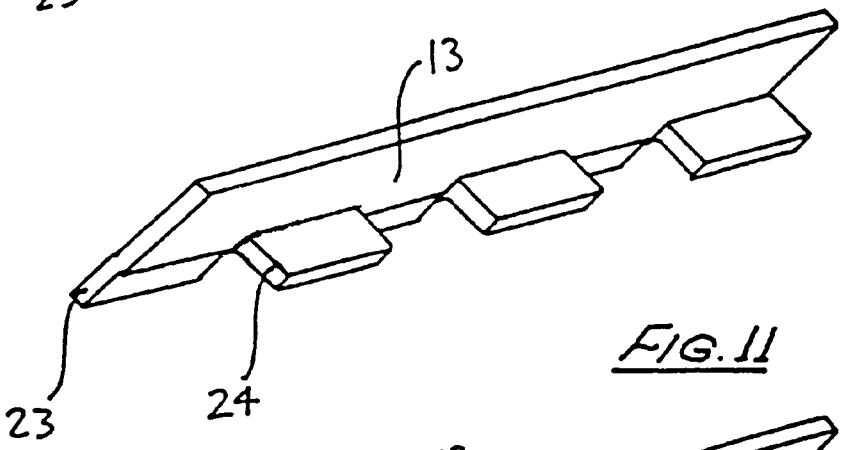
FIG. 11 is an embodiment of an aligning spline for use with the second embodiment of the cladding board according to the invention.
Figure 12:
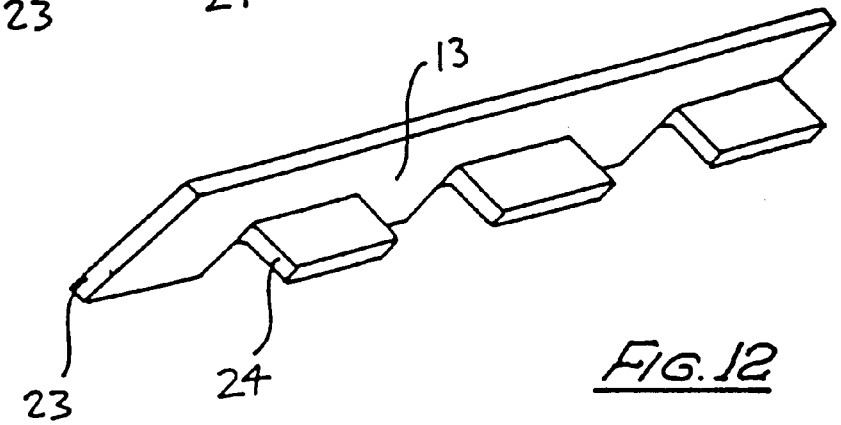
FIG. 12 is an embodiment of an aligning spline for use with the fifth embodiment of the cladding board according to the invention.

The board 10 is shown in FIG. 3 attached to a building frame 15. In use, boards 10 are fixed to building frame 15 by fasteners 16 which may take the form of screws or nails or other such devices. Aligning spline 13 then locates itself against the top face 17 of the next lowest self aligning board and holds the first face 11 in an overlapping relationship with the opposing face of the adjacent board. The fasteners 16 are inserted through the top portion at the board 10 into the building frame 15.

Generally, fasteners 16 are inserted through board 10 in such a position as to be concealed by the next highest overlapping board 10.

In this particular embodiment, aligning spline 13 is an extrusion which has an end profile of a flat rectangular member 18 having an extension 19.

Referring to FIGS. 4 to 8 there is as shown self aligning boards having alternative embodiments of the formation 12 and complementary aligning spline 13. In the embodiment shown in FIG. 8 the retaining formation 12 is in the form of a dovetail. Surfaces 14*a* and 14*b* are provided on the internal edge of the complementary dovetailed recess.

In the first embodiment the edge 20 of the spline is trimmed parallel to, and flush with, the back face 21 of the board it overlaps. This ensures the upper board seats snugly against the lower board. Alternatively, as shown in FIGS. 4 to 8 edge 20 can be made shorter than the length of the top face 17 of the board it overlaps.

Generally, the aligning spline has a constant profile along it's length.

FIGS. 9 to 12, however, show different examples of the aligning spline 13. In these examples the angled extensions 23 and 24 of the spline that engage the board 10 are discontinuous but are still able to be captively retained by the complementary formation 12. The four discontinuous embodiments shown are particularly advantageous when forming the aligning spline from a flat piece of steel plate or similar at it can simply be pressed into the configuration shown. This method of construction can provide significant cost savings over extruded aligning splines.

The aligning spline is generally inserted into the cladding board on-site and prior to application to a building frame. Accordingly this provides for a cladding board that is easier to transport and stack than conventional boards with a factory fitted spline. The aligning spline is also less prone to damage due to it being inserted into the cladding board on-site.

Although the invention has been described with reference to a specific example, it will be appreciated by those skilled in the art that the invention may be embodied in many other forms.

What is claimed is:

1. A cladding board system fixing a cladding board in partial overlapping relationship with a like cladding board against a surface to be clad, said cladding board system including:

a longitudinally extending first face of said cladding board, which, in use, faces said surface to be clad and partially overlaps with said like cladding board;

a retaining formation in, and extending longitudinally substantially along an entire longitudinal extent of the first face of the cladding board;

the retaining formation of said cladding board having mutually divergent surfaces extending from said first face into said cladding board; and a unitary aligning spline having a first end including a complementary retaining formation;

said second face of said cladding board being free of any retaining formations and any aligning splines;

the retaining formation of the cladding board adapted to slidably receive and captively retain the complimentary retaining formation of the first end of the aligning spline;

a second end of said aligning spline extending in use beyond the first face of said cladding board outward from said retaining formation and cladding board toward said surface to be clad and providing positioning for said cladding board on a top edge of said like cladding board and without interposing structure between adjacent surfaces of said cladding board and like cladding board.

2. A cladding board system as claimed in claim 1, wherein said aligning spline is releasably engageable with said board.

3. A cladding board system as claimed in claim 2, wherein:

the cladding board is fibre reinforced cement;

the retaining formation includes a pair of outwardly diverging recesses, each said recess including one of said two surfaces therein;

said recesses in combination form a V-shaped recess, the apex of the V-shaped recess co-incident with the first face;

the two said recesses extend into the first face at approximately 45° and approximately 135° to the first face respectively;

the aligning spline has an end profile of a flat rectangular member having an extension, the extension and the corresponding end of the rectangle being configured to mate with the recesses in the board and the aligning spline is adapted to slide longitudinally along the retaining formation; and the complementary retaining formation is one of continuous along the length of the aligning spline or intermittent along the length of the aligning spline.

4. A cladding board system as claimed in claim 1, wherein the cladding board is fibre reinforced cement.

5. A cladding board system as claimed in claim 1, wherein the retaining formation includes two outwardly diverging surfaces extending into said board.

6. A cladding board system as claimed in claim 5, wherein the retaining formation includes a pair of outwardly diverging recesses, each said recess including one of said two surfaces therein.

7. A cladding board system as claimed in claim 6, wherein said recesses in combination form a V-shaped recess, the apex of the V-shaped recess co-incident with the first face.

8. A cladding board system as claimed in claim 6, wherein the two said recesses extend into the first face at approximately 45° and approximately 135° to the first face respectively.

9. A cladding board system as claimed in claim 6, wherein the aligning spline has an end profile of a flat rectangular member having an extension, the extension and the corresponding end of the rectangle being configured to mate with the recesses in the board.

10. A cladding board system as claimed in claim 5, wherein said retaining formation includes a dovetailed recess, each internal edge of the dovetailed recess including one of each said two surfaces.

11. A cladding board system as claimed in claim 10, wherein the aligning spline has an end profile of a dovetail configured to mate with the dovetailed recess in the board.

12. A cladding board system as claimed in claim 1, wherein the complementary retaining formation is continuous along the length of the aligning spline.

13. A cladding board system as claimed in claim 1, wherein the complementary retaining formation is intermittent along the length of the aligning spline.

14. A cladding board system as claimed in claim 1 wherein the aligning spline is adapted to slide longitudinally along the retaining formation.

* * * * *